US005647182A

United States Patent [19]

Rutherford

[11] Patent Number: 5,647,182

[45] Date of Patent: Jul. 15, 1997

[54] CORNER CAP WITH UNITARY PRONGS

[75] Inventor: Barry Rutherford, Chatsworth, Calif.

[73] Assignee: Flannery, Inc., San Fernando, Calif.

[21] Appl. No.: 564,732

[22] Filed: Nov. 29, 1995

[51] Int. Cl.[6] ..... E04B 2/00

[52] U.S. Cl. ..... 52/287.1; 52/255; 52/277; 52/712; 52/417; 248/220.1; 248/300

[58] Field of Search ..... 52/287.1, 288.1, 52/256, 255, 277, 276, 417, 712, 716.1; 248/220.1, 300

[56] References Cited

U.S. PATENT DOCUMENTS

| | | | |
|---|---|---|---|
| 1,025,424 | 5/1912 | Priddle . | |
| 1,085,403 | 1/1914 | Clark . | |
| 1,151,554 | 8/1915 | Allyn . | |
| 1,938,474 | 12/1933 | Wilhoyte | 52/256 |
| 2,121,213 | 6/1938 | Small | 52/277 |
| 2,718,673 | 9/1955 | Nelsson | 52/276 |
| 3,323,264 | 6/1967 | Cross | 52/281 |
| 3,692,265 | 9/1972 | Barriger | 248/220.1 |
| 3,981,251 | 9/1976 | Damberg | 248/220.1 |
| 5,045,374 | 9/1991 | Tucker | 428/83 |
| 5,086,598 | 2/1992 | Weldy | 52/288 |
| 5,131,198 | 7/1992 | Ritchie et al. | 52/287 |
| 5,249,405 | 10/1993 | Miller | 52/712 |
| 5,291,717 | 3/1994 | Turner | 52/745 |
| 5,313,754 | 5/1994 | Jensen | 52/255 |

*Primary Examiner*—Carl D. Friedman
*Assistant Examiner*—Winnie Yip
*Attorney, Agent, or Firm*—Christie, Parker & Hale, LLP

[57] ABSTRACT

A single sheet of metal such as galvanized steel is formed to provide an improved corner cap for the juncture of three walls. The improved cap has three legs having three arcuate regions extending from an apex into orthogonal or transverse planes. Each arcuate region has two lateral flanges. The prongs are formed by cutting and bending a piece of the flange so that the prong and the flange form a right angle. The corner piece is constructed to cover an outside corner for use on the outer portion of three adjoining walls. The apex region at the center of the three legs defines a raised portion against which corner beads will fit to provide an easy alignment mechanism for the corner beads, as well as a smooth surface.

12 Claims, 4 Drawing Sheets

CORNER CAP WITH UNITARY PRONGS

FIELD OF THE INVENTION

The present invention relates to improved metal corner pieces for covering corners of exterior walls constructed with standard sheets of drywall. The invention also relates to a method for manufacturing the improved corner pieces.

BACKGROUND OF THE INVENTION

Interior walls are typically constructed out of sheets of drywall. Metal corner pieces have long been used in the art of constructing interior walls to protect the junctures formed by two drywall sheets. Metal corner caps are used to secure, stabilize and protect the juncture of three adjacent surfaces such as for a built-in mantel, low partition walls, or stairways where there are outside corners. Metal corner beads are used to secure, stabilize and protect the juncture of two walls forming a ninety degree corner (or other angles as well). Typically these pieces consist of pieces of metal that are folded to form flanges. The flanges typically contain nail holes through which the corner beads are secured to the two walls. A typical corner cap consists of three sets of flanges extending laterally in three orthogonal planes. Each set of flanges forms a right angle so that it can fit the juncture of two walls.

In current practice, the corner pieces are fitted onto the corner and nailed to adjacent sheets of drywall which form the walls. After the corner pieces are secured they are usually covered with tape and plaster to provide a smooth undetectable finish. The pieces protect the exposed edges of the drywall sheets which typically consist of bare plaster. The corner pieces also provide stability to corner junctures which are most often vulnerable to pressure that can occur when the corner is inadvertently hit by a person or an object.

Corner pieces are popular in the building industry because they provide an inexpensive means to achieve professional finishing for wall construction. Metal corner pieces are typically formed from single sheets of metal such as galvanized steel which are die punched and then bent into the necessary shape. The pieces can therefore be mass produced at a relatively low cost.

A major disadvantage of current metal corner pieces however is that the installer must hold the piece in place while he or she secures it to the adjacent walls. This presents a difficulty because the installer must also hold the nail that is being used to secure the corner piece. The installer must therefore hold the corner piece and the nail with one hand while he or she uses the other hand to hold a hammer. This overload of function may lead to a misaligned installation of the corner piece or damage to the adjacent walls from an errant hit of the hammer.

SUMMARY OF THE INVENTION

The corner pieces of this invention provide structure and protection to junctures formed by sheets of drywall. The corner pieces of this invention can be adapted for exterior junctures consisting of three walls.

The corner pieces of this invention are formed out of single sheets of metal. The metal is die cut and folded to form the corner piece. This method of construction assures that the corner pieces can be manufactured at a relatively low cost.

The corner pieces of this invention comprise three arcuate legs extending from a central member, each leg having a pair of lateral flanges. The legs contain a unique feature not found in prior art corner pieces. Each leg contains unitarily formed prongs which are used to secure the corner piece in place without nails. The prongs take the form of tapered strips of metal which can be hammered into the drywall to secure the corner piece. The corner piece has an apex comprising a central raised curved portion that acts as a guide for each corner bead which each of the three legs fit under. The corner bead is slid against the corner piece and the end of the corner bead abuts the central raised curved portion. The corner beads are then nailed in place.

BRIEF DESCRIPTION OF THE DRAWINGS

Further objects and advantages of the present invention can be found in the detailed description of the preferred embodiments when reviewed in conjunction with the accompanying drawings in which.

DETAILED DESCRIPTION

Figure 1:
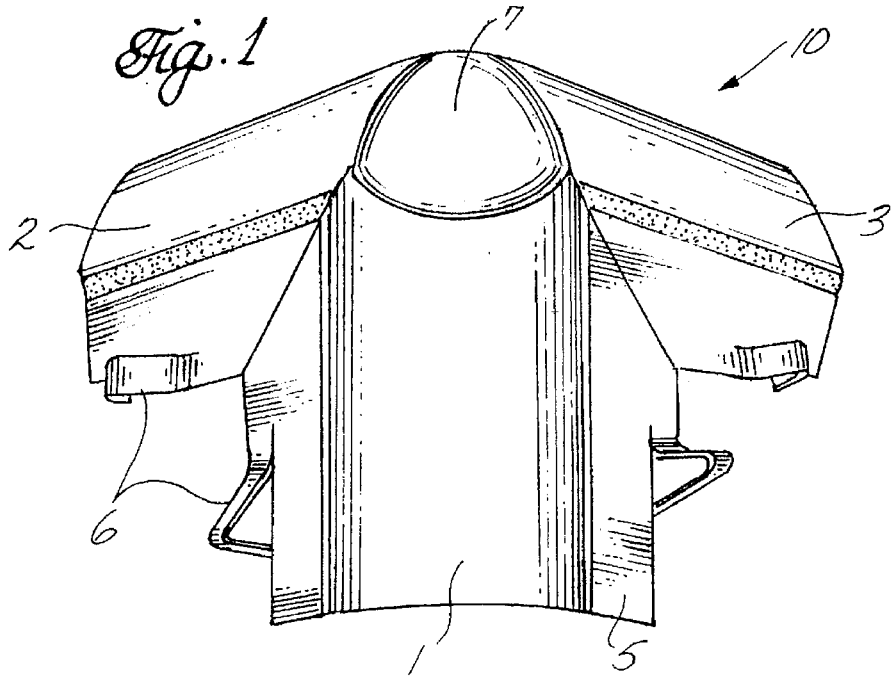
FIG. 1 illustrates a perspective view of the corner piece of the invention as it would be applied to an outside drywall corner.

Turning now to the drawings where like numerals identify like elements throughout the various views, FIG. 1 illustrates an outside corner piece 10 of the present invention. Corner piece 10 contains three arcuate regions 1, 2 and 3 which each shield a perpendicular juncture of two drywall sheets. Arcuate regions 1, 2 and 3 extend into three orthogonal planes to cover each two wall juncture present in a square outside corner. Arcuate regions 1, 2 and 3 also provide protection for the juncture which consists of the unfinished edges of three drywall walls or surfaces. Arcuate regions 1, 2 and 3 are joined at apex 7. Apex 7 provides protection to the outermost portion of the drywall corner which consists of the corner edges of three drywall sheets. Arcuate regions 1, 2 and 3 are formed by bending a unitary sheet of metal such as galvanized steel at apex 7.

On either side of each arcuate region 1, 2 and 3 are flanges 5 having prongs 6 which take the form of strips of metal separated from corner piece 10 by a single lateral cut on the outermost portions of arcuate regions 1, 2 and 3 to cantilever the prong. The prongs 6 have tapered ends **6*a* and are bent at a ninety degree angle so that the tapered end will be directed at the drywall sheet when corner piece 10 is positioned on the corner. Since the ends of prongs 6 are tapered, they readily can be hammered into the drywall sheet to affix corner piece 10 to the drywall. Prongs 6** eliminate the problem that occurs when an installer seeks to hold a corner piece in place while simultaneously holding a nail and attempting to drive the nail into the drywall with a hammer.

When corner piece 10 is positioned properly on the corner and secured with prongs 6, flanges 5 are positioned flush on the surface of each drywall sheet. More particularly flanges 5 of the two adjacent arcuate regions bordering the corner of a drywall sheet are positioned flush on the broad surface of that sheet. Flanges 5 are formed from the same unitary sheet of metal as the remainder of corner piece 10.

Figure 2:
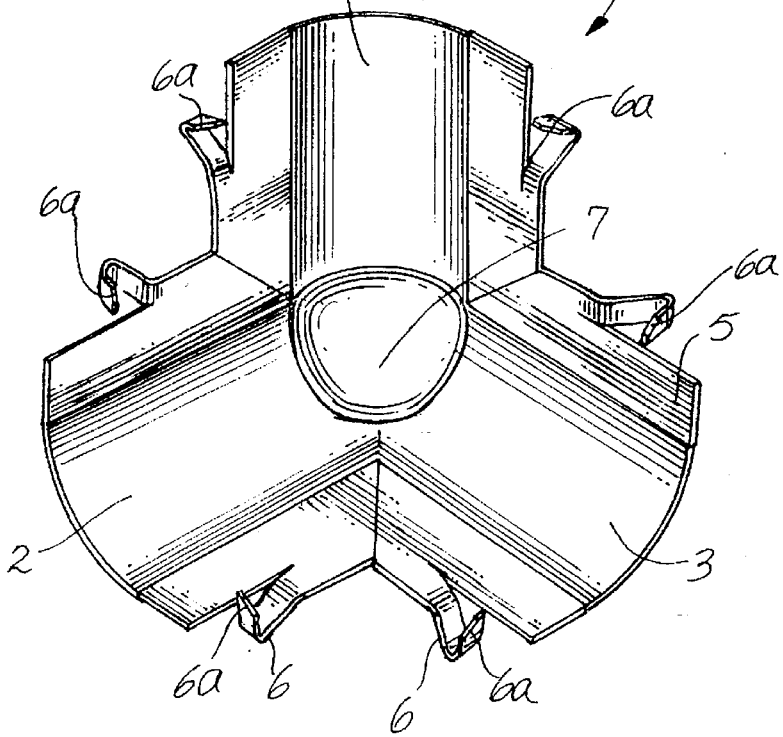
FIG. 2 illustrates another perspective view of the invention embodied for an outside corner seen from the inside of the corner piece.
Figure 3:
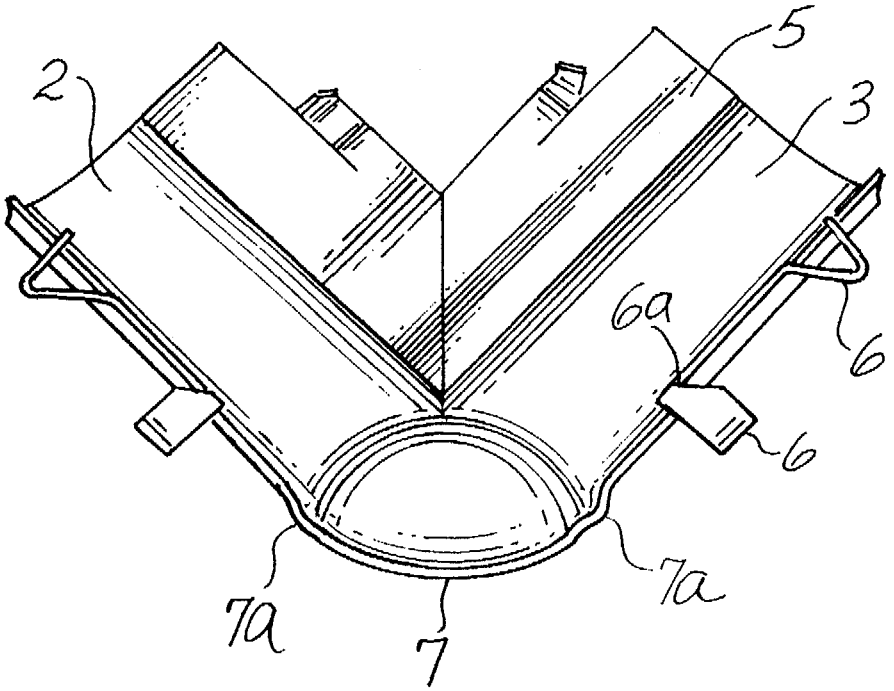
FIG. 3 illustrates a top view of the corner piece as embodied for an outside drywall corner.

FIG. 2 illustrates the underside 9 of corner piece 10. Underside 9 will be flush with the corner when it is installed. FIG. 3 illustrates a top view of corner piece 10, and clearly shows the tapered ends 6a of prongs 6 which will be forced into the drywall sheets to secure corner piece 10 to the drywall corner. When the prongs are hammered in the portion of the prong which does not enter the drywall will be flush against the drywall.

Figure 4:
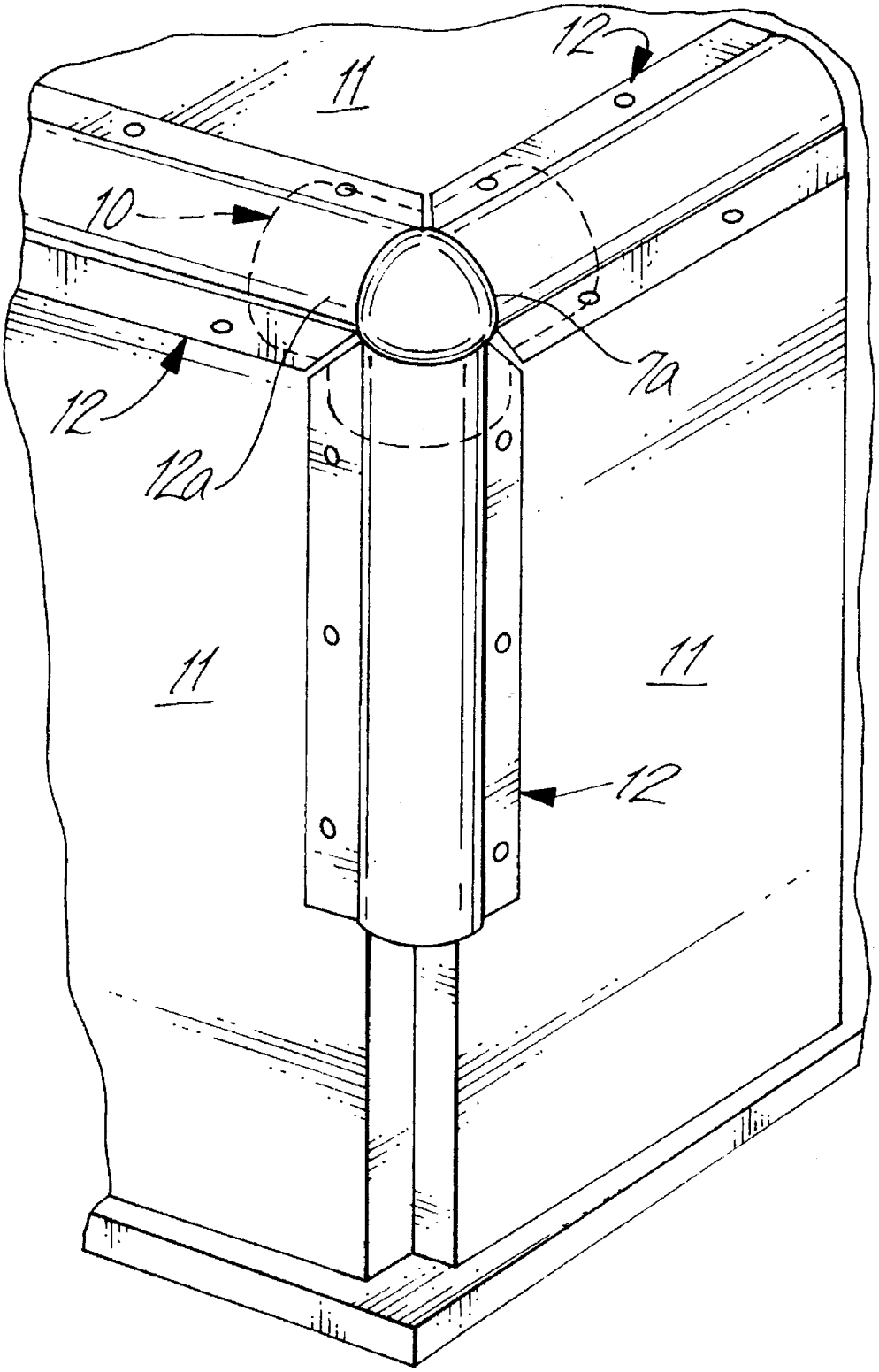
FIG. 4 illustrates a corner piece according to the invention applied to a drywall corner with corner beads mating with the corner piece.

FIG. 4 shows corner piece 10 installed on an outside corner formed by three pieces of drywall 11. As can be seen from FIG. 4, and FIGS. 1 and 3 as well as the other figures, the apex 7 has a raised central arcuate region formed by three ridges 7a. These ridges 7a act as a stopper or guide for an arcuate portion 12a of each corner bead 12. Preferably, the height of the ridges 7a is the same or substantially the same as a thickness of the corner bead to provide a smooth surface for tape and plaster. For installation, the corner piece is positioned and the prongs are hammered in. Then the corner beads are positioned with their ends overlapping the legs of the corner piece, and abutting the ridges 7a. The corner beads are then nailed in conventionally and further hold the corner piece in place.

Figure 5:
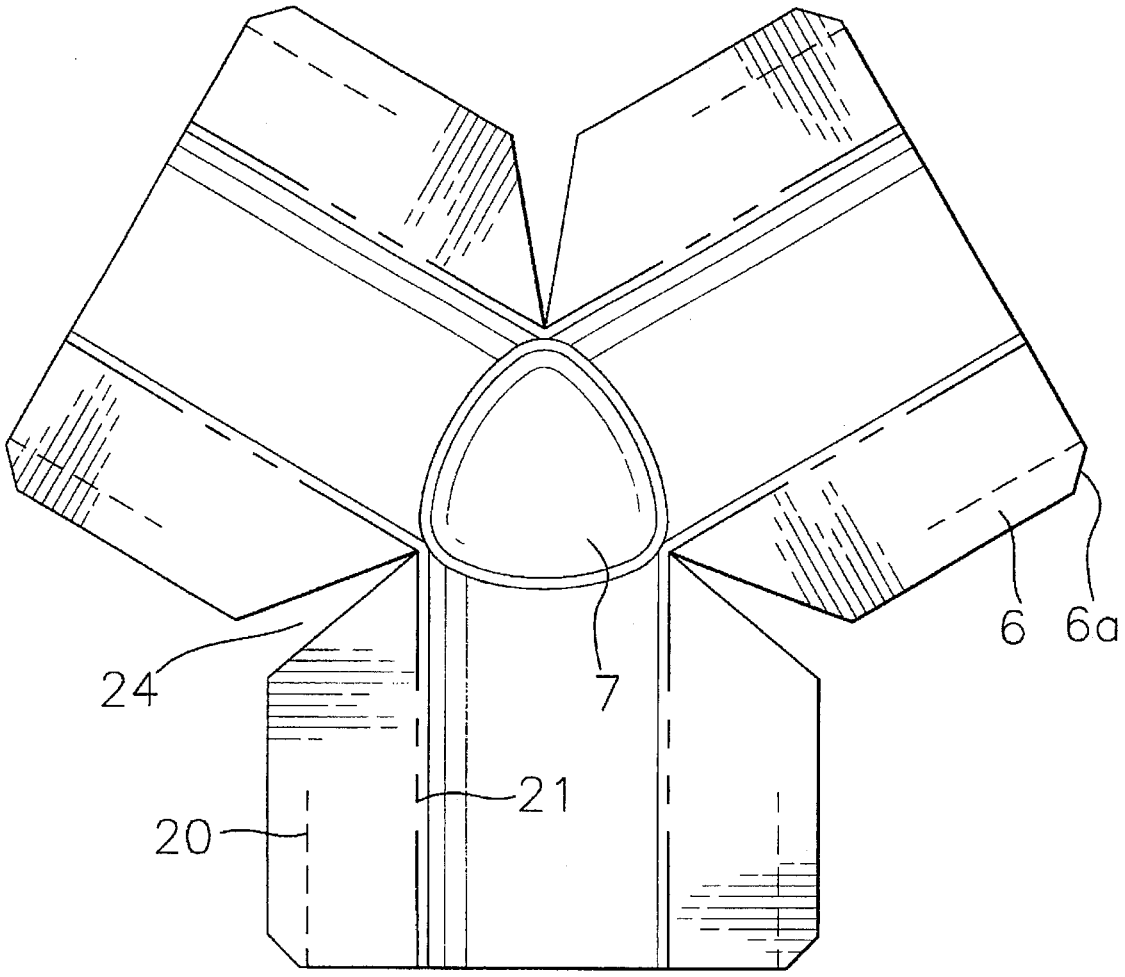
FIG. 5 illustrates a diagrammatic top view for explaining a method of forming the corner piece.

FIG. 5 illustrates the method of die-cutting the corner piece 10 from a suitable piece of metal, e.g., a sheet of galvanized steel. The dashed lines 20 show cuts for forming the prongs 6, and the dot-dash lines 21 show where the flanges will be bent. The exterior edges of the corner piece may be die cut at the same time from a larger piece of metal, and thus triangular cuts 24 may be made to simplify bending of the three orthogonal pieces. Tapered edges 6a are also preferably die cut at the same time. The apex 7 takes shape after bending the three legs to mutually orthogonal positions, or other desired angles but it is shown in FIG. 5 for reference.

What is claimed is:

1. A corner piece for use in drywall construction to hold a corner formed between three wall surfaces together, comprising:

a central member for covering an exterior surface of a drywall corner formed by three adjacent walls;

three legs extending in mutually transverse directions from the central member, each leg having an arcuate region adapted to cover an exterior junction formed between two adjacent walls, wherein each leg is flanked by a pair of laterally extending flanges for contacting an exterior surface of two adjacent walls of the three walls, wherein the arcuate rehion has a raised ridge adhacent the central member, and each flange has a prong with a tapered end formed unitarily in the flange and extending transverse to the flange for entering through an exterior surface of one of the walls.

2. A corner piece according to claim 1 wherein the central member comprises means for abutting edges of corner beads.

3. A corner piece according to claim 1 wherein each tapered end extends substantially perpendicular to the flange in which it is formed.

4. A corner piece accordingly to claim 1 wherein the three legs are mutually orthogonal.

5. The corner piece of claim 1 wherein the corner piece is metal.

6. A drywall corner assembly for three adjacent walls defining three linear joints and a corner, the assembly comprising:

three corner beads each for covering the three linear joints, respectively, and a corner piece for covering an exterior surface of the corner, the corner piece comprising:

a central member for covering the exterior surface of the corner;

three legs each connected and extending in mutually transverse directions away from the central member, each leg having an arcuate region adapted to accommodate placement over an exterior junction formed between two adjacent walls, wherein each leg is flanked by a pair of laterally extending flanges for contacting two adjacent walls of the three walls, wherein each flange has a prong with a tapered end formed unitarily the along an outer edge of flange and extending transverse to the flange for entering through an exterior surface of one of the walls, and wherein an end of each corner bead overlaps a respective leg of the corner piece.

7. An assembly according to claim 6 wherein the central member comprises an arcuate region formed by three ridges each for mating with the end of each corner bead, respectively.

8. An assembly according to claim 6 wherein the central member comprises an arcuate region raised with respect to the three legs for mating with the end of each corner bead.

9. An assembly according to claim 6 wherein the central member comprises means for abutting the end of each corner bead.

10. The assembly of claim 6 wherein the corner piece is metal.

11. A drywall corner assembly for three adjacent walls defining three linear joints and a corner, the assembly comprising:

a corner cover having:

a central member adapted for placement over a central portion of an exterior corner surface of the drywall corner;

three legs each integral with the central member and extending therefrom in mutually transverse directions, each leg comprising:

an arcuate region adapted to accommodate placement over an exterior surface of a junction formed between two of the three walls;

a pair of flanges each disposed along a lengthwise edge of each leg, the arcuate region being interposed between the pair of flanges and having a raised ridge adhacent to said central member, the flanges being adapted to contact adjacent exterior wall surfaces; and a prong integral with and projecting transversely away from each flange, the prong having a tapered end for accommodating insertion into an adjacent exterior wall surface;

wherein the corner cover is adapted to be attached to the exterior surface of the corner by insertion of the prongs of each leg flange into an adjacent wall surface;

three corner beads disposed over a respective exterior junction formed between two of the three walls, each leg being disposed over a terminal end portion of a respective corner bead.

12. A device for covering and securing an exterior corner formed from three adjacent walls, the device comprising:

a central member adapted for placement over a central portion of the exterior corner;

three legs each integral with the central member and extending therefrom in mutually transverse directions, each leg comprising:

an arcuate region adapted to accommodate placement over an exterior surface of a junction formed between two of the three walls;

a pair of flanges each disposed along a lengthwise edge of each leg, the arcuate region being interposed between the pair of flanges, the flanges being adapted to contact adjacent exterior wall surfaces;

a prong integral with and projecting transversely away from an outer edge each flange, the prong having a tapered end for accommodating insertion into an adjacent exterior wall surface;

wherein placement of the device over the exterior corner and insertion of the prongs of each leg flange into an adjacent wall serves to secure the three walls together; and wherein the outside surface of each leg is adapted to be covered by a terminal end portion of a respective corner bead.

* * * * *